US005429881A

United States Patent [19]

Aono et al.

[11] Patent Number: 5,429,881

[45] Date of Patent: Jul. 4, 1995

[54] SURFACE TREATED ALUMINUM OR ALUMINUM ALLOY MATERIAL

[75] Inventors: Masamichi Aono, Toyota; Toshihiro Chikada, Okazaki; Souichi Hayashi, Nagoya; Asao Mochizuki, Toyota; Hiroshi Sato, Kobe; Kouki Ikeda, Kobe; Jun Hisamoto, Kobe; Nagisa Takee, Nishinomiya; Toshiki Ueda, Kobe; Masao Takemoto, Shimonoseki; Hideo Fujimoto, Tochigi; Akihiro Tsuruno; Kikuo Toyose, both of Mooka, all of Japan

[73] Assignees: Toyota Jidosha Kabushiki Kaisha, Toyota; Kabushiki Kaisha Kobe Seiko Sho, Kobe, both of Japan

[21] Appl. No.: 195,338

[22] Filed: Feb. 14, 1994

Related U.S. Application Data

[62] Division of Ser. No. 704,041, May 22, 1991, abandoned.

[30] Foreign Application Priority Data

| | | | |
|---|---|---|---|
| May 23, 1990 | [JP] | Japan | 2-134331 |
| May 25, 1990 | [JP] | Japan | 2-136640 |
| Dec. 27, 1990 | [JP] | Japan | 2-416759 |
| Dec. 27, 1990 | [JP] | Japan | 2-416760 |
| Dec. 27, 1990 | [JP] | Japan | 2-416761 |

[51] Int. Cl.[6] ..... B32B 15/20

[52] U.S. Cl. ..... 428/632; 428/650; 428/653; 428/472.3

[58] Field of Search ..... 428/614, 653, 650, 658, 428/659, 632, 472.3, 935, 936; 205/109, 110

[56] References Cited

U.S. PATENT DOCUMENTS

| | | | |
|---|---|---|---|
| 4,125,679 | 11/1978 | Mino et al. | 428/659 |
| 4,243,730 | 1/1981 | Nakayama et al. | 428/659 |
| 4,655,882 | 4/1987 | Hiramatsu et al. | 205/109 |
| 4,670,354 | 6/1987 | Polard et al. | 428/659 |
| 4,839,241 | 6/1989 | Abe et al. | 205/109 |
| 4,857,154 | 8/1989 | Shindo et al. | 205/109 |
| 4,908,279 | 3/1990 | Yusuke et al. | 428/659 |
| 4,910,095 | 3/1990 | Izaki et al. | 428/659 |
| 4,913,746 | 4/1990 | Marder et al. | 205/245 |
| 5,049,453 | 9/1991 | Suemitsu et al. | 428/659 |

FOREIGN PATENT DOCUMENTS

| | | | |
|---|---|---|---|
| 0174019 | 3/1986 | European Pat. Off. | 428/659 |
| 49-32410 | 8/1974 | Japan . | |
| 58-210193 | 12/1983 | Japan | 428/659 |
| 60-110861 | 6/1985 | Japan . | |
| 60-141898 | 7/1985 | Japan | 205/109 |
| 60-197893 | 10/1985 | Japan | 428/659 |
| 61-96083 | 5/1986 | Japan . | |
| 61-157693 | 7/1986 | Japan . | |
| 1-176551 | 7/1989 | Japan | 428/659 |
| 2-11799 | 3/1990 | Japan . | |
| 2-19488 | 3/1990 | Japan . | |

OTHER PUBLICATIONS

Frederick A. Lowenheim, "Modern Electroplating", The Electrochemical Society, N.Y., 1953, pp. 31–33, 556–560, no month.

Frederick A. Lowenheim, "Electroplating", McGraw-Hill Book Co. 1978, pp. 90–91 no month.

*Primary Examiner*—John Zimmerman

*Attorney, Agent, or Firm*—Oblon, Spivak, McClelland, Maier & Neustadt

[57] ABSTRACT

Surface-treated Al or Al alloy materials which excel in adhesive property, formability, weldability, phosphatability, paint adhesion, and post-painting corrosion resistance are provided by forming a coated layer containing Zn and Fe or one or more of Si oxides, Al oxides and Al hydroxides together therewith, on the surface of Al or Al alloy base. The surface-treated Al or Al alloy materials are useful as metallic material to be painted and used after press forming and other processing, spot or laser welding and phosphating, including panel materials for automobiles and other various vehicles, shells for housefold electrical apparatus, and building materials.

19 Claims, 1 Drawing Sheet

SURFACE TREATED ALUMINUM OR ALUMINUM ALLOY MATERIAL

This is a division of application Ser. No. 07/704,041, filed on May 22, 1991, now abandoned.

BACKGROUND OF THE INVENTION

1. Field of the Invention

The present invention relates to surface-treated Aluminum or Aluminum alloy materials which excel in adhesive property, formability, weldability, phosphatability, paint adhesion, and post-painting corrosion resistance. These are used in applications wherein they are painted and used after subjected to press forming and other processing, spot or laser welding and phosphate treatment, including panel materials for automobiles and other various vehicles, shells for household electrical apparatus, and building materials.

2. Description of the Prior Art

Aluminum or aluminum alloy materials (hereinafter identified as Al alloy materials) are lightweight and possess superb corrosion resistance and designability, and have found extensive applications as shells for household electrical appliances and building materials.

During recent years, Al alloy materials have come to be employed in automobiles and other vehicles in order to reduce the weight of the body. With this, there have been increasing opportunities for them to be pressed, welded and further painted.

However, since Al alloy materials have their surfaces covered with a stable oxide film (passive state coating), they are poor in adhesion, formability, weldability (spot welding and laser welding) and paintability. They have poorer phosphatability, which is done as a surface treatment before painting, and thus there is the problem that paint adhesion and post-painting corrosion resistance are not improved. In the field of automobiles, the various parts are press-formed into a specified form, assembled with spot welding and laser welding, or joined to the specified locations with adhesive. Al alloy materials possess inferior adhesive property and formability when compared to the ordinary steel plate, and also have inferior spot weldability and laser weldability.

During a phosphating process conducted to improve paintability, Al dissolves from the surface of an Al alloy material into a phosphating bath, and the dissolved Al ion impedes the formation of phosphate coatings on the surface of the metal to be treated. To overcome this problem, in Patent Publication No. 157693/1986, a process is proposed in which Zn or Fe plating is formed on the surface of Al alloy materials, to prevent the dissolution of Al ions. These coated layers have poor adhesive property on Al alloy materials, so that exfoliation of these coatings occurs during press forming or spot welding. Accordingly, Al dissolves, preventing the formation of a fine phosphating coating, or the bare Al surface is oxidized resulting in poor phosphating property, if the waiting time from the press forming to phosphating process is longer.

SUMMARY OF THE INVENTION

The present invention has been made considering the aforestated circumstances. The objective hereof is to provide surface-treated Al or Al alloy materials which are excellent in formability and phosphatability, and also in paint film adhesive property after phosphating and corrosion resistance after painting (filiform corrosion resistance and film blister resistance).

Another objective of this invention is to provide Al or Al alloy materials having good weldability and adhesive property.

A further objective of the present invention is to provide painted surface-treated Al or Al alloy materials excelling in paint film adhesive property and corrosion resistance by phosphating said surface-treated Al or Al alloy materials to form a better conversion coating and painting the same.

The other objectives of this invention will be clarified when the following descriptions are read through.

DISCLOSURE OF THE INVENTION

The above objectives of the present invention can be accomplished by forming on the surface of Al alloy base materials:

(1) a coating chiefly comprised of Zn and Fe, preferably a Zn-Fe coating which contains 1 to 99 wt % Zn and 99 to 1 wt % Fe, is metallographically structured of a mixed phase of $\eta$ phase of Zn and $\alpha$ phase of Fe and contains no intermetallic compounds;

(2) a Zn-Fe coating whose average crystal particle size constituting the coating is less than 0.5 $\mu$m, preferably a Zn-Fe coating which is identified as containing 1 to 25 wt % Fe and 99 to 75 wt % Zn, in addition to the above requirement;

(3) a compound coating comprised of:

1 to 25 wt % Fe;

98 to 55 wt % Zn; and, 1 to 20 wt % of a compound selected from among Si oxides, Al oxides and Al hydroxides.

The above Zn-Fe coating improves formability, adhesive property, spot weldability, and laser weldability, as well as remarkably enhances phosphatability. Such effects can be displayed most effectively by setting the coating weight of the above Zn-Fe coating at 0.1 to 3 g/m$^2$.

In phosphating a surface-treated Al alloy material on which the above Zn-Fe coating is formed, all of the Zn and Fe in said coating are converted into chemical conversion coatings consisting of hopeite and/or phosphophyllite at the time of conclusion of the above phosphating process; thereafter, paint coatings are formed, The above mentioned process can give painted Al alloy materials with superb paint adhesion and post-coating corrosion resistance.

BRIEF DESCRIPTION OF DRAWINGS

FIG. 1 is a graph indicating relationships between the bead drawing load and coating weight in a bead drawing test, while FIG. 2 is a graph depicting relationships between the rectangular tube drawing height and coating weight in a rectangular tube drawing test.

DETAILED DESCRIPTION OF THE INVENTION

Figure 1:
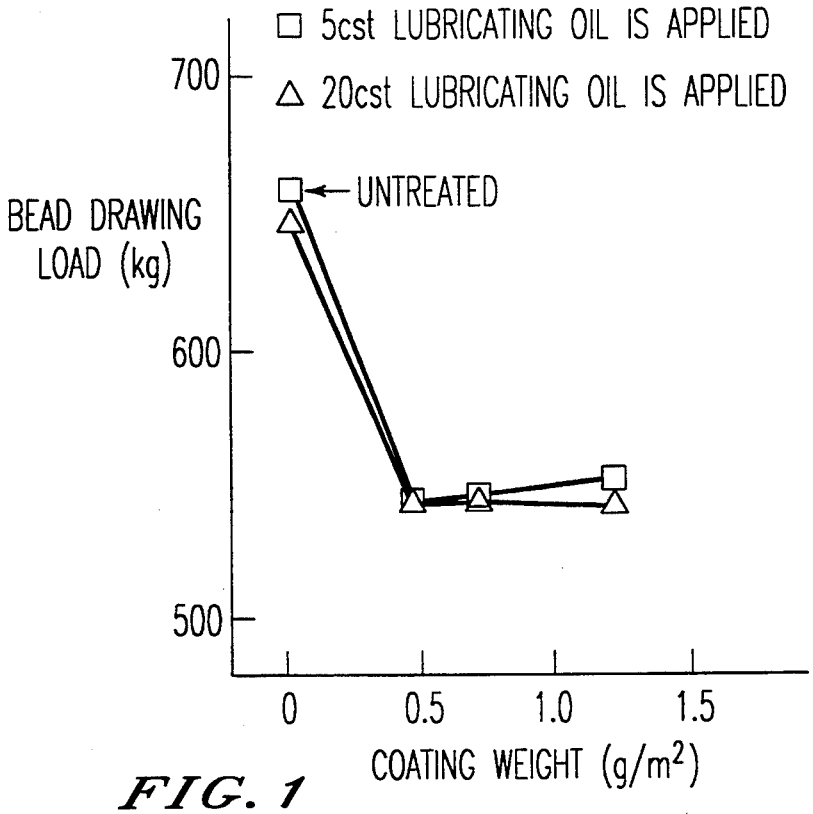
FIGS. 1 and 2 show the test results obtained with embodiments of the present invention.

The inventors of the present invention first examined the formation of coated layers primarily composed of Zn and Fe with good lubricating ability on the surface of Al alloy materials, in order to improve the formability thereof. It was found that even with the same Zn-Fe coating composition, formability varies with varying phase structures. In the Zn-Fe coating produced by normal electroplating, Zn-Fe intermetallic compounds, including Γ phase and δ phase are generated, thereby making it easier for the coating to peel off during forming. This is presumably due to the fact that since the foregoing Zn-Fe intermetallic compounds are hard and brittle, they are subjected to the so-called powdering phenomenon in which they are cracked during processing and peel off in a powdery fashion.

Nevertheless, where the phase structure of a Zn-Fe coating is of a mixed phase of η phase of Zn and α phase of Fe, and does not contain any Zn-Fe intermetallic compound, it was confirmed that no such powdering phenomenon occurs, giving excellent formability. It was also confirmed that said η phase and α phase in the Zn-Fe coating forms a local cell, with the above η phase as anode and α phase as cathode on the surface of the coating during a phosphating process, thus making it easier to form an even and fine phosphated coating.

There is no restriction on the procedures for the formation of Zn-Fe coating with the aforestated phase construction. Yet, it can be easily obtained by the use of a displacement plating using a plating bath containing Zn and Fe ions. The content of Zn and Fe in the Zn-Fe coating can be set in a range as wide as 1 to 99 wt % for Zn and 1 to 99 wt % for Fe, preferably 80 to 98 wt % for Zn and 2 to 20 wt % for Fe.

The effect on formability of the phase construction of Zn-Fe coatings has been discussed above.

In addition to this, the average grain size of the crystals constituting the Zn-Fe coating is closely related to formability. The coatings with a mean grain size of less than 0.5 μm offer good lubricating ability and excellent processability. They can also produce a fine phosphate coating because a greater number of nuclei are generated in the formation thereof during a phosphate treatment due to finer grain sizes of the crystals. As a result, the adhesion of the paint thereon is enhanced, and the post-painting corrosion resistance improved.

To obtain Zn-Fe coatings with the above mean crystal grain size, the contents of Zn and Fe constituting the coating should be set at 99 to 75 wt % for Zn and 1 to 25 wt % for Fe, preferably at 98 to 80 wt % for Zn and 2 to 20 wt % for Fe. When the Zn-Fe coating that meets this requirement for mean crystal grain size consists of the above-mentioned mixture of η phase of Zn and α phase of Fe, it offers much better formability and phosphatability. Al alloy materials having Zn-Fe coatings meeting the above constituent requirement are exceedingly good in adhesion property, and they can be adhered strongly on various adherents using known adhesives.

As previously discussed, according to the present invention, formability, adhesion property and phosphatability of Zn-Fe coatings which are formed on the surface of Al alloy base materials can be improved by specifying the phase construction or mean crystal grain size thereof. Furthermore, it was confirmed that the coatings whose laser reflectance on the surface of the Zn-Fe coating is less than 3% provide extremely good laser weldability, and that reliable welding couplings can be obtained with high-speed welding using laser beams.

As another means to improve the formability, adhesive property and phosphatability of Al alloy base materials, is a procedure to include at least one chemical to be selected from among the Si oxides, Al oxides and Al hydroxides into a Zn-Fe coating. By leaving these oxides and hydroxides diffused in the Zn-Fe coatings, these provide a solid lubricant effect, and the sliding characteristics of said coating during forming are improved markedly in combination with the lubricating operation the Zn-Fe coating materials themselves possess, providing superb formability. Si oxides, Al oxides and Al hydroxides function to improve the affinity with adhesives having a polar group, contributing to the improvement in adhesive property. These oxides and hydroxides have large electrical resistance and help to increase exothermic efficiency during spot welding, hence enhancing formability and spot weldability. In such a case, since the Al oxides and Al hydroxides could degrade phosphatability, it is preferred that they are caused to disperse into the Zn-Fe coating to prevent the excessive precipitation thereof to the surface, and that they are allowed to exist in a dispersed state where Zn-Fe is a continuous phase. The Si oxides will not reduce phosphatability, and hence they can be stratified on the surface of Zn-Fe coatings. This permits improving adhesion property, formability and spot weldabilty more effectively.

To improve the adhesion of such coating on an Al alloy base material, it is preferred to make the interface side thereof Fe-rich. The most preferred coating composition in a composite coating of Zn, Fe and Si oxides is of roughly three-layer structure in which the interface side of the Al alloy base material is an Fe-rich layer, the upper side a Zn-rich layer, and a Si oxide layer is formed on the uppermost layer side. It is to be noted that these various layers allow some interdiffusion thereamong.

As has been discussed earlier, in a coating in which Si oxides, Al oxides or Al hydroxides are compounded with Zn and Fe, the lubricating action of Si oxides gives better formability, and hence any phase structure and mean crystal grain size of Zn and Fe are applicable. In this case, however, it is of course preferable to structure the Zn-Fe phase to constitute a mixed phase of η phase of Zn and α phase of Fe as previously mentioned, and to make the mean crystal grain size 0.5 μm or less. Such coating can be readily obtained by displacement plating, as also discussed above. Surface treated Al alloy materials thus obtained are preferred because they exhibit superior laser weldability when the reflectance of laser beams stands at less than 3%, hence allowing efficacious and stable laser welding. The preferable Composition ratio is as follows:

Zn: 98 to 55 wt % (more preferably 95 to 60 wt %)

Fe: 1 to 25 wt % (more preferably 2 to 20 wt %)

At least one compound (A) selected from the group consisting of Si oxides, Al oxides and Al hydroxides: 1 to 20 wt % (more preferably 3 to 20 wt %)

If the content of the compound (A) is less than the range as mentioned above, the effect of the addition thereof is not sufficiently exhibited. On the contrary, if it is excessive, the coating becomes brittle, and is more apt to cause powdering during forming. If the content of Fe in the coating is less than the range as mentioned above, formability and phosphatability are insufficient. If it is beyond the above scope, the adhesiveness of the coating on the Al alloy base material is reduced, causing peeling of the coating in press forming.

The structure of the coating produced on the surface of Al alloy base materials according to the present invention is as indicated above. It contains Zn and Fe and one or more of the compounds (A) to be selected from the group of Si oxides, Al oxides and Al hydroxides together with the Zn and Fe as essential components. The coating may contain as other components, a very tiny amount of Cu, Mg, Cr, Mn and other metals and oxides and hydroxides thereof as long as they do not adversely affect the aforestated effects.

The preferred method of forming the coating is displacement plating, electroplating or a combination of both, the most preferable of them being displacement plating. If the displacement method is employed, it can be performed normally with an alkaline solution containing Zn ions and Fe ions as the plating bath. If Al ions are allowed to exist in this plating bath, a composite coating can be provided in which Zn-Fe is a continuous phase and Al hydroxides are dispersed therein. If silicate is allowed to exist in the plating bath, a coating can be obtained in which a Si oxide layer is formed on the topmost Zn-Fe layer. If electroplating is conducted while stirring an acid Zn-Fe coating liquid in which Al oxide powder is dispersed, a composite coating can be formed in which Al oxides are diffused in Zn-Fe.

There are no special limitations on the kind of Al alloy base materials to which the present invention is applicable. They can include Al and various Al alloys containing more than one of the metals, such as Mg, Cu, Mn, Si, Zn, Cr, and Ni, as alloy element, the most commonly used of which are Al-Mg alloys and Al-Mg-Si alloys. It is also possible to employ pure Al alloy as base material. The base material, in shapes such as plate-shaped objects (thin plates and thick plates), rod shapes, linear shapes and tube shapes, can be used depending on applications and objectives.

The surface-treated Al alloy materials of the present invention are obtained by being formed with a press, joined with other members by welding, forming a chemical conversion coating through phosphate treatments, and then forming a cosmetic coating. In order to improve the paintability, paint adhesion and post-paint corrosion resistance of the paint during formation of the coating, it has become apparent that all of the Zn and Fe in the aforestated Zn-Fe coating should be converted into a chemical conversion coating which consists of zinc phosphate (hopeite) and/or zinc iron phosphate (phosphophyllite) to eliminate Zn and Fe in a chemically converted state.

Galvanized steels are prepared primarily to use sacrificial anode action of Zn coatings to improve the corrosion resistance thereof, and in order to improve the corrosion resistance (particularly anti-perforating property) of the steel, it is necessary to leave the Zn coating even after a phosphate treatment. Producing Zn-Fe coating on Al alloy base materials according to the present invention is for the purpose of improving phosphatability, as well as adhesion, formability and weldability as previously discussed. Al alloy materials themselves possess good anti-perforation property, and hence it is not required to leave the Zn-Fe coatings even after phosphate treatments are applied to improve paint adhesion for enhanced paint adhesion following a press forming and welding operation. Rather, if the metal Zn and Fe remain after the chemical conversion treatment, they cause corrosion reaction under corrosive environments, giving rise to blisters.

In phosphating the aforestated surface-treated Al alloy materials of the present invention prior to paint application, if all of the Zn and Fe in the Zn-Fe coating is converted into zinc phosphate (hopeite) and/or zinc iron phosphate (phosphophyllite) prior to paint application, then superb paint adhesion can be obtained, and there is no blister. Good post-paint corrosion resistance can be shown even when the painted Al alloy material is exposed to corrosive environments.

The composition of chemical conversion coatings (phosphate-treated coatings) provided by phosphate treatment depends on the content of Zn and Fe which constitute the Zn-Fe coatings. Where the content of Fe in the coating is less than approximately 70 wt %, a chemical conversion coating composed substantially of zinc phosphate is given. Where the content of Fe is beyond 70 wt %, a chemical conversion coating consisting of a mixture of zinc phosphate and zinc iron phosphate is provided. Both phosphate-treated coatings give peerless paint adhesion and post-paint corrosion resistance.

For the surface-treated alloy materials according to the present invention, all of the Zn and Fe in Zn-Fe coatings subjected to phosphate treatment must be converted into phosphate. If the thickness of the Zn-Fe coating is too thick, Zn and Fe could remain after the phosphate treatment, making it impossible to fully improve post-paint corrosion resistance. Accordingly, the thickness should be controlled to around 3 $g/m^2$ or less in the coating weight of Zn-Fe coatings, more preferably to some 2.0 $g/m^2$ or less. If the coating weight is too small, it becomes difficult to cover the surface of Al alloy base materials evenly with coating materials, making it difficult to fully improve formability and weldability,. The coating weight should be 0.1 $g/m^2$ or greater, more preferably 0.5 $g/m^2$ or more.

The Al alloy materials covered with the Zn-Fe coating whose weight Is 0.1 to 3 $g/m^2$, more preferably 0.5 to 2.0 $g/m^2$ provide excellent formability, weldability and phosphatability due to the action of the coating. The Zn and Fe in said coatings are all converted into chemical conversion coatings, comprised of zinc phosphate or zinc iron phosphate, providing superb paintability and painted Al alloy materials with good post-paint corrosion resistance which causes no blister.

There is no special restriction on the kinds of coatings to be applied on the surface of chemical conversion coatings (phosphate-treated coatings), but especially preferred is the one whose primary component is a resin having a polar group, including hydroxyl group and amino group, in the molecule thereof. Use of such resin paint forms a hydrogen bond between the polar group in the coatings and the phosphate-treated coating, giving a high level of paint adhesion, as well as post-paint corrosion resistance. These preferred resin coatings include epoxy resin coatings, alkydmelamine resin coatings, acryl resin coatings, and polybutadiene resin coatings. The epoxy resin coatings and alkydmelamine resin coatings are, among others, excellent in paint film characteristics, and thus are recommended as particularly preferable.

Then, examples will be illustrated to give more specific description of the construction and operation of the present invention, which is not restricted by the following embodiments.

EXAMPLE

Example 1

In order to confirm the improvements in formability and phosphatability by structuring the phase of the Zn-Fe coatings formed on the surface of Al alloy base materials in a mixed structure of $\eta$ phase and $\alpha$ phase, the following experiments were conducted.

Using a rolled plate made up of an Al plate, Al-Mg alloy (JIS A 5182) and Al-Si-Mg alloy (JIS A 6009), various Zn-Fe platings as indicated in Table 1 were provided on the surface thereof by displacement plating or electroplating to examine the phase structure of the coating with an X ray diffraction method. For the coating weight and coating constitution of the coatings of the coating weight was determined from the reduced amount of the weight after the coating was dissolved and removed with concentrated nitric acid, and the coating composition determined through the chemical analysis of the dissolved coating composition. The formability and phosphatability of the coating materials obtained were examined in the following procedures. The result is shown in Table 1.

Formability: evaluated on the basis of the maximum height in an Ericksen cupping test Size of Al alloy base material: 1.0×70×200 mm Wrinkle control power: 1.1 mmt Punch diameter: 20 mmΦ

Evaluation:

○ Max. height: more than 9 mm

Δ Max. height: 8.5 to 9 mm

X Max. height: 3.5 mm

Phosphatability: evaluated for-coated percentage of tage of the phosphate-treated coating subjected to a 2-min. phosphate treatment using commercially available immersion type phosphate treatment liquid ("Palbond U" by Nihon Parkerizing Co., LTD.)

Evaluation:

○ Coating percentage more than 95%

Δ Coating percentage 85 to 95%

X Coating percentage 85% or less

TABLE 1

| No | Constitution of coating: Kind | Phase structure | Coating weight ($g/m^2$) | 1) Plating procedure | Formability | Phospatability |
|---|---|---|---|---|---|---|
| | | Examples | | | | |
| 1 | Zn-5%Fe | $\eta + \alpha$ | 1.0 | A | ○ | ○ |
| 2 | Zn-10%Fe | $\eta + \alpha$ | 0.5 | A | ○ | ○ |
| 3 | Zn-25%Fe | $\eta + \alpha$ | 1.0 | A | ○ | ○ |
| 4 | Zn-50%Fe | $\eta + \alpha$ | 1.0 | A | ○ | ○ |
| 5 | Zn-80%Fe | $\alpha + \eta$ | 2.0 | A | ○ | ○ |
| 6 | Zn-95%Fe | $\alpha + \eta$ | 3.0 | A | ○ | ○ |
| 7 | Zn-5%Fe-5%SiO2 | $\eta + \alpha$ | 1.5 | A | ○ | ○ |
| 8 | Zn-25%Fe-10%Al(OH)3 | $\eta + \alpha$ | 2.0 | A | ○ | ○ |
| 9 | Zn-10%Fe-3%SiO2-15%Al(OH)3 | $\eta + \alpha$ | 0.8 | A | ○ | ○ |
| | | References | | | | |
| 10 | Zn-15%Fe | $\eta + \alpha$ | 0.03 | A | X | X |
| 11 | Zn-25%Fe | $\delta_1 + \Gamma$ | 1.0 | A | X | Δ |
| 12 | Zn-25%Fe | $\eta + \delta_1 + \Gamma$ | 2.0 | A | Δ | ○ |
| 13 | Zn-60%Fe | $\alpha + \Gamma$ | 2.0 | B | Δ | ○ |
| 14 | Zn-60%Fe | $\alpha + \Gamma$ | 5.0 | B | X | ○ |
| 15 | — | — | — | — | X | X |

1) Plating procedures
A: Ordianary dispalcement plating
B: Ordinary electroplating As indicated in Table 1, the embodiments 1 to 9 of the present invention offered superior formability and phosphatability, and no peeling of the coating was found. On the other hand, poorer formability or phosphatability was shown in reference examples 10, 11 to 14 and 15, respectively because the coating weight was insufficient (for reference example 10), because the coatings were not comprised of $\eta$ phase and $\alpha$ phase (for reference examples 11 to 14), and because no coatings were formed (for reference example 15). In the reference examples 13 and 14 in which coatings were formed by the normal electroplating method, peeling off of the coatings occurred since Zn-Fe intermetallic compound was contained therein.

Example 2

In order to confirm the effect upon formability and post-painting corrosion resistance of the mean crystal grain size in the Zn-Fe coating formed on the surface of Al alloy base materials, the following experiments were conducted.

Using the same Al alloy rolled plate as was employed in Example 1, various Zn-Fe coatings as shown in Table 2 were formed on the surface thereof by displacement plating or electroplating. As a means to mix $SiO_2$, $Al_2O_2$, or Al $(OH)_3$ in the Zn-Fe coatings, a displacement plating using a bath containing silicate and Al ions and $Al_2O_3$ dispersive plating in Table 2 were adopted. The mean crystal grain size in the coatings obtained were examined through observation with a scanning electron microscope. These coatings were examined for formability and filiform corrosion resistance after coating in the following methods. The results are indicated collectively in Table 2.

Formability: evaluated on the basis of drawing height in a rectangular tube drawing test.

Shape of Al alloy base material: 1.0×90×90 (mm)

Wrinkle control force: 2 ton

Punch diameter: 40 mm Φ

Evaluation Criteria

Drawing height of rectangular tube more than 13 mm

Drawing height of rectangular tube 12 to 13 mm

Drawing height of rectangular tube 12 mm or less

Filiform corrosion resistance: The coating under test was subjected to phosphate treatment, with all the Zn and Fe in the Zn-Fe coating converted into hopeite or phosphophyllite, forming a paint film by applying 20 μm epoxy coating (by Nippon Paint Co., LTD.). The paint film was cross-cut to make evaluations based on the length of filiform corrosion which occurs after 8 cycles of the following corrosion tests.

Salt spray test (35° C.×24 H)

Humidity cabinet test (80% RH, 50° C.×120 H)

Allowed to stand in a room (room temperature x 24 H)

Evaluation Criteria

○ Length of filiform corrosion 1 mm or less
Δ Length of filiform corrosion 1 to 2 mm
X Length of filiform corrosion 2 mm or more ity and post-paint corrosion resistance (filiform corrosion resistance) in the following procedures.

Formability: Identical to the evaluation method as indicated in Example I above.

TABLE 2

| No | Surface layer | Plating-procedures 1) | Average grain size (μm) | Coating Weight (g/m²) | Formability | Filiform corrosion resistance |
|---|---|---|---|---|---|---|
| | | Examples | | | | |
| 1 | Zn-5%Fe | A | 0.1 | 3.0 | ○ | ○ |
| 2 | Zn-10%Fe | A | 0.4 | 0.2 | ○ | ○ |
| 3 | Zn-1%Fe | A | 0.3 | 1.5 | ○ | ○ |
| 4 | Zn-10%Fe- | A | 0.5 | 2.0 | ○ | ○ |
| 5 | Zn-10%Fe-3%$SiO_2$ | A | 0.2 | 1.0 | ○ | ○ |
| 6 | Zn-5%Fe-5%$Al_2O_3$ | B | 0.5 | 2.0 | ○ | ○ |
| 7 | Zn-5%Fe-S%SiO2-10%Al(OH)3 | A | 0.4 | 0.6 | ○ | ○ |
| | | References | | | | |
| 8 | — | — | — | — | X | X |
| 9 | Zn-0.5%Fe | A | 0.2 | 1.5 | Δ | Δ |
| 10 | Zn-30%Fe | A | 0.3 | 3.0 | X | Δ |
| 11 | Zn-10%Fe | A | 1.0 | 2.0 | X | X |
| 12 | Zn-15%Fe | A | 0.3 | 5.0 | X | X |
| 13 | Zn-5%Fe | B | 0.7 | 4.0 | X | X |

1) Plating procedures
A: Ordinary dispalcement plating
B: Ordinary electroplating As indicated in Table 2, Nos. 1 through 7, which meet the specified requirement of the present invention offered superior formability and filiform corrosion resistance, with no peeling of the coating observed. On the contrary, Nos. 8, 9, 10, 11 and 13, and 12 show poorer formability and filiform corrosion resistance. This was due to the following respective reasons: no plating was provided for No. 8, the content of Fe was too low for No. 9, the content of Fe was too high for No. 10, the mean crystal grain size in the coating was too large for Nos. 11 and 13, and the coating weight was too excessive for No. 12.

Example 3

To determine the effect exerted upon formability and spot weldability by the co-existence of Si oxides in the Zn-Fe coatings formed on the surface of Al alloy base materials (particularly, the existence of Si oxides on the surface side of said coating), the following test was conducted.

After the rolled plate comprised of the same Al alloy as employed in Example I was subjected to various surface treatments as indicated in Table 3, coatings of the compositions as shown in Table 3 were formed by displacement plating or electroplating. Analyses into the surface of the coatings obtained with ESCA confirmed that the coatings of the example of the present invention (Nos. 1 through 7) were formed of a metal Fe-rich layer, metal Zn-rich layer and a Si-oxide-rich layer from the interface thereof with the Ai alloy base material. The coating weight and composition of the coatings were determined in the same manner as aforestated.

The coated materials obtained through the above procedure were examined for formability, phosphatability Phosphatability: Using a commercially available immersion-type phosphate treatment solution (same as above), all of the Zn and Fe in the coatings of the metal plated materials involved were subjected to chemical conversion until they are converted into hopeite or phosphophyllite, to examine the precipitation amount and state of the phosphated coatings (chemical conversion coatings) obtained.

Precipitation state:

○: (The whole portion is covered with chemical conversion coatings.)

Δ: (Some portions are left uncovered with chemical conversion coatings.)

X: (More than ½ of the whole surface remains uncovered with chemical conversion coatings.)

Post-paint corrosion resistance (filiform Corrosion resistance): After all of the Zn and Fe in the coatings are converted into phosphate through phosphate treatment, 20 μm thick epoxy resins (by Nippon Paint Co.,LTD.) was applied to form a film. Then, after the coatings were cross cut, post-paint corrosion resistance was evaluated in terms of the length of filiform corrosion that occurs after 5 cycles of the following corrosion tests. This evaluation result was indicated as comparison with the length of filiform corrosion at the test, conducted concurrently by using cold-rolled steel sheet.

Salt spray test (5% NaCl, 35° C.×24 H)
Humidity cabinet test (50° C.×85% RH, 6 days)
Filiform corrosion resistance
◎ (better than with painted cold-rolled plate)
○ (equivalent to when painted cold-rolled plate was used)
Δ (somewhat worse than with painted cold-rolled plate)
X (worse than with painted cold-rolled plate)

TABLE 3

| | Coating forming procedure | | Analysis of coatings | | | | | |
|---|---|---|---|---|---|---|---|---|
| | Pretreatment | Plating procedure | Coating weight (g/m²) | Fe (g/m²) | Zn (g/m²) | SiOss (g/m²) | Content of Zn 1) (wt %) | Remarks |
| 1 | Alkali degrease | Displacement plating | 0.1 | 0.02 | 0.05 | 0.03 | 50 | Example |
| 2 | Alkali degrease | Displacement plating | 0.3 | 0.1 | 0.16 | 0.05 | 50 | Example |
| 3 | Alkali degrease | Displacement plating | 0.6 | 0.1 | 0.4 | 0.1 | 67 | Example |
| 4 | Nitric acid, cleaning | Displacement plating | 0.9 | 0.1 | 0.9 | 0.1 | 67 | Example |

TABLE 3-continued

| | Coating forming procedure | | Analysis of coatings | | | | | |
|---|---|---|---|---|---|---|---|---|
| | Pretreatment | Plating procedure | Coating weight ($g/m^2$) | Fe ($g/m^2$) | Zn ($g/m^2$) | SiOss ($g/m^2$) | Content of Zn [1] (wt %) | Remarks |
| 5 | Nitric acid, cleaning | Displacement plating | 0.9 | 0.01 | 0.88 | 0.01 | 97 | Example |
| 6 | Surface etching | Displacement plating | 1.6 | 0.6 | 1.0 | 0.1 | 63 | Example |
| 7 | Nitric acid, cleaning | Displacement plating | 2.5 | 0.4 | 2.0 | 0.1 | 80 | Example |
| 8 | Continous annealling only | — | 0.1 | — | — | — | 0 | Conventional |
| 9 | Surface etching | Displacement plating | 5 | 1.5 | 3.2 | 0.3 | 64 | Reference |
| 10 | Chemical displacement | Electroplating | 20 | 0.0 | 20 | 0.0 | 100 | Reference |

[1]) Zn content = (Analytical value of Zn) ÷ (Weight of Coating) × 100

TABLE 4

| No | Al alloy base material | Formability | Phosphatability: Precipitation amount ($g/m^2$) | Phosphatability: Precipitation state | Filiform corrosion resistance of coated materials | Remarks |
|---|---|---|---|---|---|---|
| 1 | A5182 | ○ | 1.7 | ○ | ◎ | Example |
| 2 | A5182 | ○ | 2.0 | ○ | ◎ | Example |
| | A6009 | ○ | 1.8 | ○ | ◎ | Example |
| 3 | A5182 | ○ | 2.3 | ○ | ◎ | Example |
| 4 | A6009 | ○ | 2.3 | ○ | ◎ | Example |
| | A5182 | ○ | 2.0 | ○ | ◎ | Example |
| 5 | A5182 | ○ | 2.4 | ○ | ◎ | Example |
| 6 | A5182 | ○ | 2.2 | ○ | ◎ | Example |
| 7 | A5182 | ○ | 2.5 | ○ | ◎ | Example |
| 8 | A5182 | X | 0.6 | X | X | Conventional |
| | A6009 | X | 0.3 | X | X | Conventional |
| 9 | A5182 | X | 2.3 | ○ | ○ | Reference |
| 10 | A5182 | X | 2.6 | ○ | X | Reference |

As shown in Tables 3 and 4, the examples of the present invention (Nos. 1 through 7) offer good formability, with no peeling off of the coatings, and give excellent phosphatability and filiform corrosion resistance after painting.

No. 8 offers poor formability, phosphatability and filiform corrosion resistance after painting since it was not subjected to plating. Nos. 9 and 10 had excessive coating weights, and thus peeling off of the coatings is easy to occur during processing, and the post-paint filiform corrosion resistance is insufficient since not all Zn and Fe can be converted during a phosphate in the coatings treatment process.

Example 4

To determine the effect on formability and spot weldability of the coexistence of Al oxides or Al hydroxides in the Zn-Fe coatings formed on the surface of Al alloy base materials, the following experiments were conducted.

Coatings of various compositions as shown in Table 5 were formed on the surface of rolled plate made up of the same Al alloy as used in Example 1 by a displacement plating or electroplating. The coated materials were examined for formability and spot weldability in the following manner. As a procedure to include Al oxides or Al hydroxides in the coatings, the one chosen was to leave Al ions and $Al_2O_3$ particulates mixed in a plating bath. As preferable embodiments, experiment results with the coated materials (with coatings on the surface of which Si oxide-rich layer was formed) are indicated in Table 5.

Formability: evaluated in terms, of the maximum draw load at a draw bead test.

Size of Al alloy base material: 10×40×400 mm
Drawing velocity: 300 mm/min.
Bead pressure: 500 kgf
Evaluation:
○ Maximum drawing load 500 kgf or less
Δ Maximum drawing load 550 to 650 kgf
X Maximum drawing load 650 kgf or more Spot weldability: evaluated on the basis of the number of continuous spots in a spot welding.

Welding current: 32 kA
Welding force: 300 kgf
Energizing time: 4/50 s
Electrode: Cu-1% Cr
Evaluation:
○ Number of continuous spots 300 or more
Δ Number of continuous spots 250 to 300
Number of continuous spots 250 or less

TABLE 5

| No | Coating constitution: Type of plating | Content of Al hydrooxide/oxide (%) | Coating weight ($g/m^2$) | Thickness of upper layer of Si oxide (μm) | Formability | Spot weldability |
|---|---|---|---|---|---|---|
| | | | Exemples | | | |
| 1 | Zn - 5%Fe | 1 | 1.0 | — | ○ | ○ |
| 2 | | 10 | 0.1 | | ○ | ○ |
| 3 | | 20 | 1.5 | | ○ | ○ |
| 4 | Zn -10%Fe | 5 | 0.8 | | ○ | ○ |
| 5 | Zn - 1%Fe | 10 | 3.0 | | ○ | ○ |
| 6 | Zn - 10%Fe | 5 | 0.5 | | ○ | ○ |
| 7 | Zn - 5%Fe | 10 | 0.8 | 1.0 | ○ | ◎ |
| | | | References | | | |
| 8 | | — | | — | X | X |
| 9 | Zn -10%Fe | 0.5 | 1.0 | | Δ | Δ |
| 10 | | 25 | 0.5 | | X | ○ |
| 11 | | 10 | 0.05 | | Δ | X |
| 12 | Zn-0.5%Fe | 5 | 0.8 | | Δ | Δ |

TABLE 5-continued

| No | Type of plating | Coating constitution: Content of Al hydrooxide/oxide (%) | Coating weight ($g/m^2$) | Thickness of upper layer of Si oxide (μm) | Formability | Spot weldability |
|---|---|---|---|---|---|---|
| 13 | Zn - 25%Fe | 15 | 5.0 | | X | ○ |
| 14 | Zn - 5%Fe | 5 | 1.5 | 1.0 | Δ | X |

As indicated in Table 5, Nos. 1 through 7, which meet the specified requirements of the present invention, offered good formability and spot weldability, with no peeling off of the coatings occurring. On the contrary, no coatings were formed for No. 8; the content of Al hydroxides or Al oxides was insufficient for No. 9; the content of Al hydroxides or Al oxides was excessive for No. 10; the coating weight was insufficient for No. 11; the content of Fe in the coatings was insufficient for No. 12; the content of Fe was excessive for No. 13; and, the thickness of Si oxides was too much. For these reasons, these metal plated materials offer poorer formability or spot weldability.

The metal plated materials of Nos. 1 through 7 above were phosphate-treated as in the same manner in Example 2, and applied with epoxy resin paint to examine for filiform corrosion resistance. All of them indicated excellent phosphatability and good filiform corrosion resistance after painting.

To confirm the effect of improvements in formability with the Zn-Fe coatings in which $SiO_2$ and $Al_{23}$ were diffused, the following experiments were conducted further.

By using Al alloy (Al-4.5 Mg-0.4 Cu) as base material, and providing chemical displacement plating onto the surface thereof in a similar manner as described above, various coatings with different coating weights (0 to 1.25 $g/m^2$ comprised of Zn (87.3%)-Fe(3.8%)-$SiO_2$(3.5%)-$Al_2O_3$(5.4%) were formed. With the various metal plated materials obtained, formability tests (bead drawing test and rectangular drawing test) were made in a similar manner as described above, giving the results as indicated in FIGS. 1 and 2.

Figure 2:
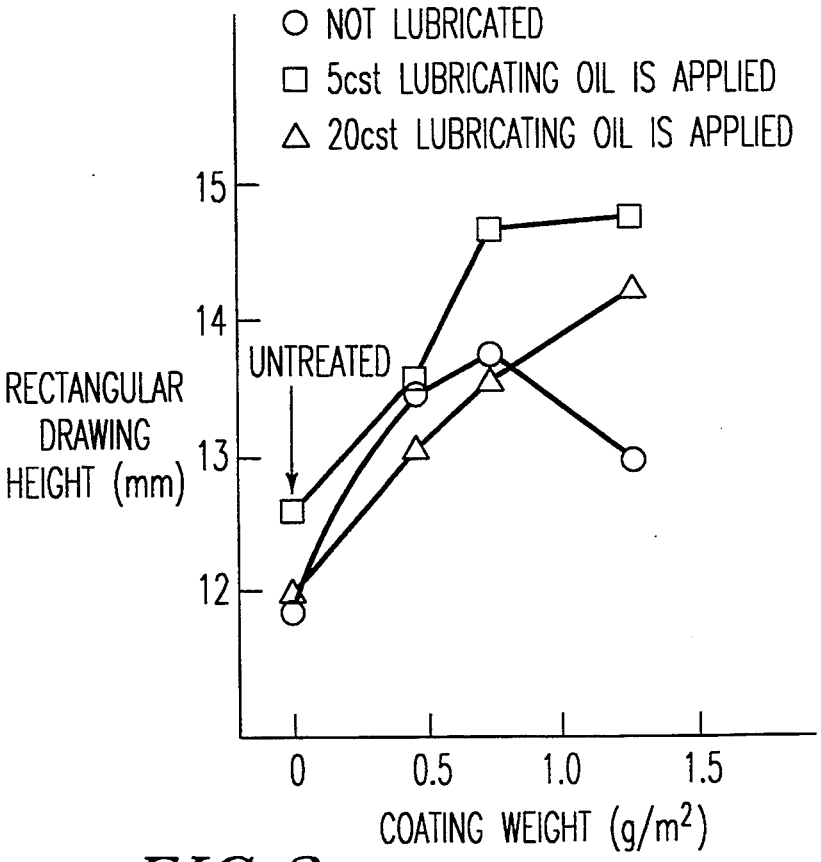

FIG. 1 indicates the results of the bead drawing test, which shows the effect of coating weight on bead drawing load. FIG. 2 shows the results of the rectangular drawing test, which indicates the effect of coating weight on rectangular drawing height.

As is apparent from these figures, even when lubricating oil is used during a process, the metal plated materials with no coatings formed thereon provide extremely poor formability, but they offer markedly improved formability when coatings are formed. Superb formability can be obtained by making the coating weight 0.5 $g/m^2$ or more.

Example 5

As has become apparent in Example 4 above, the metal plated materials in which Si oxide-rich layers are formed in the topmost layer of the Zn-Fe coatings exhibit excellent characteristics in formability and spot weldability. Furthermore it was confirmed that adhesion property is remarkably enhanced, and hence the results will be indicated below.

With 0.8 mm-thick alloy plate (for T-shaped peeling test) made up of Al-Mg alloy (JIS A 5182) and 1.6 mm-thick Al alloy plate (for shearing test), chemical displacement plating was provided on both Al alloy plates using a plating bath containing 5 to 10% $SiO_2$ together with Zn ions and Fe ions, forming Zn-Fe coatings with compositions as indicated in Table 6.

The metal plated materials obtained were subjected to 180° T-shaped peeling tests (adhesion area=25 mm wide×75 mm long) and 180° shearing test (adhesion area=25 mm wide×12 mm long) using epoxy structural adhesive or synthetic rubber adhesive as adhesive, in accordance with the procedures as specified in JIS K 6829, examining the adhesive property based on the broken area of the interface at the adhesive broken surface. The smaller broken area of the interface means the better adhesive property between the material under test and the adhesive. The tensile speed at the time of T-shaped peeling test was 200 mm/min. and that of the sheer test at 50 mm/min.

To determine the adhesion of the coatings on Al alloy plates, the peeling area of the coatings when the cellophane tape adhered on the surface thereof is forced off. The smaller peeling area means the better adhesion of the coatings on Al alloy base material.

The results are indicated as shown in Table 6 collectively. Zn-Fe metal plated materials having Si oxide-rich layers in the topmost layer thereof are found to offer good adhesion with Al alloy base material and excellent adhesive property when joined with adhesive.

TABLE 6

| | Coating constitution: Primary elements | Coating Weight ($g/m^2$) | Plating procedure | Adhesiveness with base material (%) | Adhesive | Adhesion characteristics (%): T-shaped peeling | Shearing test | Remarks |
|---|---|---|---|---|---|---|---|---|
| 1 | Zn - 3%Fe - 3.5%Si oxide | 0.5 | Chemical displacement plating | 0 | Expxy | 0 | 0 | Examples of the present invention |
| 2 | Zn - 10%Fe - 3.5%Si oxide | 1.0 | | 0 | | 0 | 0 | |
| 3 | Zn - 20%Fe - 3.5%Si oxide | 1.5 | | 0 | | 0 | 0 | |
| 4 | Zn - 3%Fe - 3.5%Si oxide | 2.5 | | 0 | | 0 | 0 | |
| 5 | Zn - 3%Fe - 3.5%Si oxide | 1.0 | | 0 | | 0 | 0 | |
| 6 | Zn - 3%Fe - 3.5%Si oxide | 0.5 | Chemical displacement plating | 0 | Synthetic rubber | 0 | 0 | Examples of the present invention |
| 7 | Zn - 3%Fe - 3.5%Si oxide | 1.0 | | 0 | | 0 | 0 | |
| 8 | Zn - 3%Fe - 3.5%Si oxide | 1.5 | | 0 | | 0 | 0 | |
| 9 | Zn - 3%Fe - 3.5%Si oxide | 2.5 | | 0 | | 0 | 0 | |
| 10 | Zn - 3%Fe - 3.5%Si oxide | 1.0 | | 0 | | 0 | 0 | |
| 11 | Zn | 3.0 | Electroplating | 5 | Epoxy | 5 | 5 | Reference examples |
| 12 | Zn - 10%Fe | 0.2 | | 0 | | 10 | 15 | |

TABLE 6-continued

| | Coating constitution | | | | | Adhesion characteristics (%) | | |
|---|---|---|---|---|---|---|---|---|
| | Primary elements | Coating Weight ($g/m^2$) | Plating procedure | Adhesiveness with base material (%) | Adhesive | T-shaped peeling | Shearing test | Remarks |
| 13 | Zn - 10%Fe | 0.2 | Chemical displace- | 0 | | 15 | 20 | |
| 14 | Zn - 10%Fe | 5.0 | ment plating | 10 | | 0 | 0 | |
| 15 | Zn - 10%Fe | 0.2 | | 0 | Synthetic | 20 | 30 | |
| 16 | Zn - 10%Fe | 5.0 | | 10 | rubber | 0 | 0 | |
| 17 | None | — | — | — | | 60 | 80 | |
| 18 | Zn - 3%Fe - 3.5%Si oxide | — | — | — | Epoxy | 40 | 60 | |

Example 6

As has been apparent from the aforestated Examples 1 to 5, formability, spot weldability, phosphatability and post-paint corrosion resistance, adhesive property and the like have been improved by forming Zn-Fe coatings on the surface of Al alloy base materials. When laser reflectance was also examined, it was confirmed that metal plated materials in which the laser reflectance of the surface of the Zn-Fe coatings is less than 3% show good laser weldability. The results are indicated below.

Zn-Fe coatings of compositions as indicated in Table 7 were formed on the surface of Al-Mg alloy plates (JIS A 5052 or JIS A 5182) (average roughness along the centerline Ra=0.35 μm) with electroplating or displacement plating. Each of them were measured for laser beam reflectance, and for laser weldability.

For Nos. 4, 8, 12 and 16 in Table 7, chemical displacement plating was employed during a plating bath containing SiO2 together with Zn ions and Fe ions. For the other materials, electroplating was employed using plating bath containing Zn ions and Fe ions. The laser reflectance was determined from the reflectance when laser beams are radiated parallel with the roll direction at an incidence angle of 45° and a reflection angle of 45°. For laser welding, a $CO_2$ laser was used, with laser output at 2.5 Kw, welding speed at 1 m/min., and with shield gas being 100% Ar, and the flow rate thereof at 30 1/min. The evaluation of laser weldability was made through observations of the appearance of welded portions and internal defects in accordance with the 5-step marking, with the excellent welded portions having no defects marked at 5, and faulty ones having many defects at 1.

In Table 7, Nos. 1 to 4 and Nos. 9 to 12 show laser beam reflectance as low as 3% or below, offering good laser weldability both for butt and lap weldings. On the contrary, Nos. 5 to 7 and Nos. 13 to 15 have laser beam reflectance of more than 3%, with consequent poor laser weldability. For Nos. 8 and 16, there is too much coating weight, and SiO2 are included in the welded portion as impurities, resulting in degraded weldability. For this reason, to ensure excellent laser weldability, the laser beam reflectance on the surface of the coating should be 3% or below, and the coating weight should be controlled to 3 $g/m^2$ or less.

TABLE 7

| | | Coating constitution | | | | Laser weldability | | | | |
|---|---|---|---|---|---|---|---|---|---|---|
| | | | | | | Butt | | Lap | | |
| No | Al alloy base material | Primary Elements | Fe content (%) | Coating Weight ($g/m^2$) | Reflectance (%) | Appearance | Inside | Appearance | Inside | Remarks |
| 1 | | Zn + Fe | 10 | 0.5 | 0.5 | 5 | 5 | 4 | 5 | Materials |
| 2 | A 5052 | Zn + Fe | 5 | 1.0 | 0.2 | 5 | 5 | 5 | 5 | accoding to |
| 3 | | Zn + Fe | 5 | 2.0 | 0.1 | 5 | 5 | 5 | 5 | the present |
| 4 | | Zn + Fe + Si | 5 | 1.0 | 0.2 | 5 | 5 | 5 | 5 | invention |
| | | | 3.5 as $SiO_2$ | | | | | | | |
| 5 | | With no plating applied | | | 30 | 1 | 4 | 1 | 4 | Reference |
| 6 | | Zn | — | 0.5 | 4.5 | 3 | 2 | 2 | 3 | materials |
| 7 | | Zn + Fe | 10 | 1.0 | 4.0 | 3 | 3 | 2 | 2 | |
| 8 | | Zn + Fe + $SiO_2$ | 5 | 5.0 | 0.2 | 2 | 2 | 3 | 3 | |
| | | | 2 as $SiO_2$ | | | | | | | |
| 9 | | Zn + Fe | 10 | 0.5 | 0.5 | 5 | 5 | 5 | 5 | Materials |
| 10 | A 5182 | Zn + Fe | 5 | 1.0 | 0.2 | 5 | 5 | 5 | 5 | accoding to |
| 11 | | Zn + Fe | 5 | 2.0 | 0.1 | 5 | 4 | 5 | 5 | the present |
| 12 | | Zn + Fe + $SiO_2$ | 5 | 1.0 | 0.2 | 5 | 5 | 5 | 5 | invention |
| | | | 3.5 as $SiO_2$ | | | | | | | |
| 13 | | With no plating applied | | | 25 | 1 | 4 | 1 | 4 | Reference |
| 14 | | Zn | — | 0.5 | 4.0 | 3 | 2 | 2 | 2 | |
| 15 | | Zn + Fe | 10 | 0.1 | 4.0 | 2 | 3 | 2 | 2 | |
| 16 | | Zn + Fe + $SiO_2$ | 5 | 5.0 | 0.2 | 2 | 1 | 3 | 1 | |
| | | | 2 as $SiO_2$ | | | | | | | |

Example 7

In this example, for painted Al alloy materials which are obtained by forming Zn-Fe coatings on the surface of Al alloy base material, phosphating the same into chemical conversion coating and then applying top coat thereon, it was examined how the metal Zn and metal Fe remaining under the chemical conversion coating as ground might affect the corrosion resistance of the painted Al alloy material (filiform corrosion resistance and blister). On the surface of a rolled plate comprised of the same Al alloy as used in Example 1, 0.01 to 1 μm Zn-Fe coatings were formed by the identical displacement plating as aforestated, degreased and cleaned. Then, all of the Zn and Fe in the coatings were converted into hopeite and/or phosphophyllite with phosphate treatment. As phosphate treatment solution, "Palbond U" by Nihon Parkerlizing CQ., LTD. was employed.

On the surface of the phosphated matter obtained, alkydmelamine resin paint was applied so that the dry film thickness was about 20 μm. The resultant product was subjected to baking finish at 130° C., for 20 minutes to give painted Al alloy plates. As reference example, painted Al alloy plates were obtained in the same manner as above, except that Zn-Fe coatings were applied thereon, and thereafter some degree of phosphate treatment was provided so that some of the metal Zn and metal Fe in said coatings remained.

The plates under test obtained were examined for filiform corrosion resistance and blister resistance in the following procedures.

Filiform corrosion resistance: The surface of the plates under test was cross cut, and the filiform corrosion resistance was evaluated on the basis of the maximum length of filiform corrosion which occurred after, 4 cycles of the same corrosion tests as in Example 2, ○: Max. filiform length < 1 mm Δ: Max. filiform length 1 to 4 mm x X: Max. filiform length 4 mm <

Blister resistance: The surface of the plates under test were cross cut, and put to 840 hours of salt spray test. The maximum blister width from the cross cut portion was determined, and blister resistance was evaluated according to the following criteria.

○: Max. blister width < 1 mm

Δ: Max. blister width 1 to 4 mm x: Max. blister width 4 mm <

The results are indicated in Table 8 collectively.

1. A surface-treated Al or Al alloy material having a coating comprising at least one member selected from the group consisting of Si oxides, Al oxides and Al hydroxides; and of the metal Zn and the metal Fe, wherein the reflectance of a carbon dioxide gas laser beam with a wavelength of 10.6 μm is less than 3%.

2. A surface-treated Al or Al alloy material as specified in claim 1 wherein the composite coating is comprised of 1 to 25 weight % of Fe, 98 to 55 weight % of Zn and 1 to 20 weight % of compound to be selected from the group consisting of Si oxides, Al oxides and Al hydroxides.

3. A surface-treated Al or Al alloy material as specified in claim 1 or 2 wherein the coating is comprised of metal Fe, metal Zn and Si oxides.

4. A surface-treated Al or Al alloy material as specified in claim 3 wherein the coating is stratified in the order of metal Fe, metal Zn and Si oxides from the interface of an Al or Al alloy base material.

5. A surface-treated Al or Al alloy material as specified in claim 1 or 2 wherein the coating is comprised of metal Fe and metal Zn, and Al oxides and/or Al hydroxides.

6. A surface-treated Al or Al alloy material as specified in claim 5 wherein Al oxides and/or Al hydroxides are dispered evenly in the coating.

7. A surface-treated Al or Al alloy material as specified in claim 5 wherein a layer of Si oxide is formed on the topmost layer of the coating.

8. A surface-treated Al or Al alloy material as specified in claim 1 wherein the mean crystal grain size in the coating is 0.5 μm or less.

TABLE 8

| | Coating constitution | | Phosphated coating | | | | | |
|---|---|---|---|---|---|---|---|---|
| No | Constitution (%) | Coating weight ($g/m^2$) | Coating weight ($g/m^2$) | Type | Coating residual amount | Type of base | Filiform corrosion resistance | Blister resistance |
| 1 | Zn - 1%Fe | 0.5 | 1.5 | Popeite | 0 | Al | ○ | ○ |
| 2 | Zn - 5%Fe | 2.0 | 2.5 | Popeite | 0 | Al—Mg | ○ | ○ |
| 3 | Zn - 95%Fe | 1.0 | 2.5 | Phosphophyllite | 0 | Al—Mg | ○ | ○ |
| 4 | Zn - 20%Fe | 0.1 | 0.5 | Popeite | 0 | Al—Mg—Si | ○ | ○ |
| 5 | Zn - 80%Fe | 1.5 | 1.8 | Popeite + Phosphophyllite | 0 | Al—Mg | ○ | ○ |
| 6 | Zn - 80%Fe | 3.0 | 2.8 | Popeite + Phosphophyllite | 0 | Al—Mg—Si | ○ | ○ |
| 7 | Zn - 99%Fe | 1.0 | 0.8 | Phosphophyllite | 0 | Al—Mg—Si | ○ | ○ |
| 8 | Zn - 5%Fe - 5%$SiO_2$ | 1.0 | 0.8 | Popeite | 0 | Al | ○ | ○ |
| 9 | Zn - 10%Fe - 15%$Al(OH)_3$ | 1.5 | 2.0 | Popeite | 0 | Al—Mg | ○ | ○ |
| 10 | Zn - 2%Fe - 5%$SiO_2$-10%$Al(OH)_3$ | 1.5 | 1.5 | Popeite | 0 | Al—Mg—Si | ○ | ○ |
| 11 | Zn | 4.0 | 2.5 | Popeite | 0.8 $g/m^2$ | Al—Mg | Δ | X |
| 12 | Zn | 4.0 | 1.8 | Popeite | 1.5 $g/m^2$ | Al—Mg—Si | Δ | X |
| 13 | Zn - 90%Fe | 5.0 | 2.5 | Phosphophyllite | 2.5 $g/m^2$ | Al—Mg | ○ | X |
| 14 | Zn | 3.0 | — | — | 3.0 $g/m^2$ | Al | Δ | X |
| 15 | Zn - 80%Fe | 2.0 | 0.8 | Popeite | 0.2 $g/m^2$ | Al—Mg | ○ | Δ |
| 16 | — | — | — | — | — | Al—Mg | X | Δ |

As is apparent from Table 8, the plates in which all Zn and Fe in the coatings thereof were converted into phosphate during a phosphate treatment process (Nos. 1 to 10) offer superior filiform corrosion resistance and blister resistance. On the contrary, those in which Zn and Fe remain after phosphate treatment (Nos. 11 to 16) have poor filiform corrosion resistance or blister resistance.

As is obvious from the results, to achieve excellent corrosion resistance after—after painting according to the present invention, all of the metal Zn and the metal Fe in the Zn-Fe coatings are converted during a phosphate treatment process.

What we claim is:

9. A surface-treated Al or Al alloy material as specified in claim 1 wherein metal Fe and metal Zn in the coating are formed by a displacement plating.

10. A surface-treated Al or Al alloy material as specified in claim 1 wherein the coating weight is 0.1 to 3 $g/m^2$.

11. A surface-treated Al or Al alloy material wherein any one of the surface-treated Al or Al alloy materials as specified in claim 1 are subjected to phosphate treatment, all of the Fe and Zn in the coating are converted into a chemical conversion coating comprised of zinc phosphate and/or zinc iron phosphate, and then forming a paint coating thereon.

12. A surface-treated Al or Al alloy material having a coating comprising Si oxides, Zn metal and Fe metal, wherein said coating is stratified into three interdiffused layers, and said coating comprises:

(i) a first layer on said Al or Al alloy;

(ii) a second layer on said first layer, on a side opposite said Al or Al alloy; and (iii) a third layer on said second layer, on a side opposite said first layer;

wherein said first layer comprises more Fe metal than said second layer or said third layer, said second layer comprises more Zn metal than said first layer or said third layer, and said third layer comprises more Si oxide than said first layer or said second layer.

13. The surface-treated Al or Al alloy material having a coating of claim 12, wherein said coating further comprises Al oxide or Al hydroxide.

14. A surface-treated Al or Al alloy material as specified in claim 12, wherein the composite coating is comprised of 1 to 25 weight % of Fe, 98 to 55 weight % of Zn and 1 to 20 weight % of a compound to be selected from the group consisting of Si oxides, Al oxides and Al hydroxides.

15. A surface-treated Al or Al alloy material as specified in claim 12, wherein the mean crystal grain size in the coating is 0.5 μm or less.

16. A surface-treated Al or Al alloy material as specified in claim 12, wherein metal Fe and metal Zn in the coating are formed by a displacement plating.

17. A surface-treated Al or Al alloy material as specified in claim 12, wherein the coating weight is 0.1 to 3 $g/m^2$.

18. A surface-treated Al or Al alloy material as specified in claim 12, wherein the reflectance of a carbon dioxide gas laser beam with a wave length of 10.6 μm is less than 3%.

19. A surface-treated Al or Al alloy material as specified in claim 12 wherein the surface-treated Al or Al alloy material is subjected to phosphate treatment, all of the Fe and Zn in the coating are converted into a chemical conversion coating comprised of zinc phosphate and/or zinc iron phosphate, and then forming a paint coating thereon.

* * * * *